US006236030B1

(12) United States Patent
Neumann

(10) Patent No.: US 6,236,030 B1
(45) Date of Patent: May 22, 2001

(54) METHOD AND MEANS FOR HOT-AIR CUTTING

(75) Inventor: Karl-Erik Neumann, Gräddö (SE)

(73) Assignee: Neos Robotics AB (SE)

( * ) Notice: Subject to any disclaimer, the term of this patent is extended or adjusted under 35 U.S.C. 154(b) by 0 days.

(21) Appl. No.: 09/269,005

(22) PCT Filed: Sep. 15, 1997

(86) PCT No.: PCT/SE97/01556

§ 371 Date: Mar. 17, 1999

§ 102(e) Date: Mar. 17, 1999

(87) PCT Pub. No.: WO98/12028

PCT Pub. Date: Mar. 26, 1998

(30) Foreign Application Priority Data

Sep. 19, 1996 (SE) ..... 96 03 422

(51) Int. Cl.[7] ..... H05B 6/10; B26F 1/26; B26F 3/06

(52) U.S. Cl. ..... 219/628; 219/68; 219/635; 83/16; 83/53; 30/140; 392/379

(58) Field of Search ..... 219/628, 629, 219/630, 635, 68; 83/15, 16, 53; 392/379, 382, 383, 384; 30/140

(56) References Cited

U.S. PATENT DOCUMENTS

| | | | | |
|---|---|---|---|---|
| 2,549,362 | * | 4/1951 | Bessiere et al. | 219/628 |
| 3,445,616 | * | 5/1969 | Guyer | 219/628 |
| 3,792,989 | * | 2/1974 | Dahlberg et al. | 65/112 |
| 3,800,991 | * | 4/1974 | Grove et al. | 225/2 |
| 5,288,960 | * | 2/1994 | Rothe et al. | 219/628 |
| 5,901,270 | * | 5/1999 | Quin | 392/382 |

FOREIGN PATENT DOCUMENTS

| | | |
|---|---|---|
| 2508064 | 9/1975 | (DE) . |
| 851473 | 10/1960 | (GB) . |

* cited by examiner

*Primary Examiner*—Philip H. Leung
(74) *Attorney, Agent, or Firm*—Ostrolenk, Faber, Gerb & Soffen, LLP

(57) ABSTRACT

A method and device for hot-air cutting, wherein compressed air is forced into a hot-air unit in which the compressed air is heated, the hot air is then conducted through a cutting nozzle for hot-air cutting. A compressed-air unit is connected to a hot-air unit via a coupling device arranged at one end of the hot-air unit to provide the hot-air unit with compressed air. The hot-air unit is being provided at its other end with a cutting nozzle. A heating device is arranged to heat air flowing into the hot-air unit.

5 Claims, 1 Drawing Sheet

METHOD AND MEANS FOR HOT-AIR CUTTING

TECHNICAL FIELD

The present invention relates to cutting and working technology using hot air.

BACKGROUND ART

Previously known methods for cutting various types of plastics such as foam plastic, moulded plastic and other porous materials such as textiles use laser technology which has the drawback that the material is burned. Ultrasound is also used to cut these types of material but has the drawback of being imprecise and "spongy". High-pressure water jets are also used for cutting textiles but produce a messy edge. Electronic beam working also occurs in which electrons are thrown out from a cathode consisting of a tungsten wire, through a hole in an anode, subsequently adjusted magnetically and then concentrated by a magnetic lens. A working temperature of about 6000° C. is reached with this technology and electronic beam working is an unnecessarily complicated technology for the materials for which the present invention is suitable.

OBJECT OF THE INVENTION

The object of the present invention is to provide a method and a device for cutting and, to a certain extent, also working porous material such as foam plastic, moulded plastic and textiles, said method solving the problems of previously known methods and being simple, inexpensive and reliable.

SUMMARY OF THE INVENTION

Using compressed air which is forced into a heated tubular channel provides a hot-air jet which is forced out of a cutting nozzle at high pressure, this hot-air jet being used to cut and, to a certain extent work porous material such as foam plastic, moulded plastic and textiles.

BRIEF DESCRIPTION OF THE DRAWINGS

The invention will now be described in more detail with reference to the accompanying drawings.

DESCRIPTION OF THE INVENTION

Figure 1:
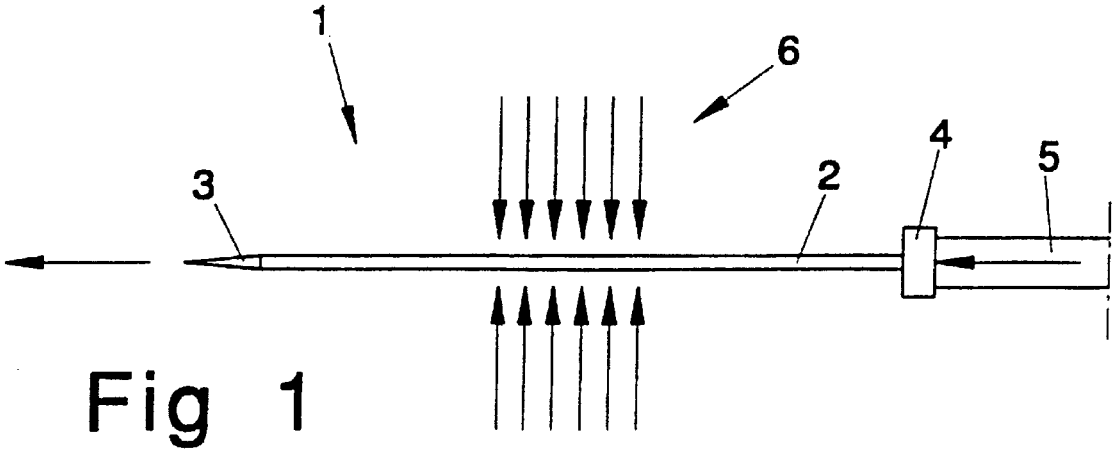
FIG. 1 shows a basic diagram of a device and a method according to the present invention.

FIG. 1 illustrates the principle of the present invention in which a cutting tool 1 comprising a hot-air unit 2 is provided at one end with a cutting nozzle 3. The hot-air unit 2 is provided at its other end with a coupling device 4 arranged to connect a compressed-air hose 5 to the hot-air unit 2. When the compressed-air hose 5 has been connected to the hot-air unit 2 compressed air can flow into the hot-air unit 2, through this and out through the cutting nozzle 3, as indicated by arrows in FIGS. 1–3. A heating device 6 is also arranged in connection with the hot-air unit 2 in order to heat the air in the unit. In the embodiment of the invention illustrated in FIG. 1, the arrows directed at right angles to the hot-air unit 2 may be represented by a burner, not shown, which heats the hot-air unit with an open flame.

The range for the operating pressure out through the cutting nozzles is 1–100 bar, depending on the material to be cut. The pressure of the air entering the hot-air unit 2 may be 6–20 bar, for instance, whereas the pressure out through the cutting nozzle will be in the order of 50 bar. The heating device 6 is arranged to heat the air flowing into the hot-air unit 2 to a temperature which can be set depending on the material to be cut or worked. For foam plastic, for instance, a temperature of about 200° C. is used and for moulded plastic a temperature of about 1000° C.

The cutting nozzle 3 is detachably connected to the hot-air unit 2 so that it can be replaced with a different nozzle particularly suited to textiles for instance, or in the case of damage or wear.

Figure 2:
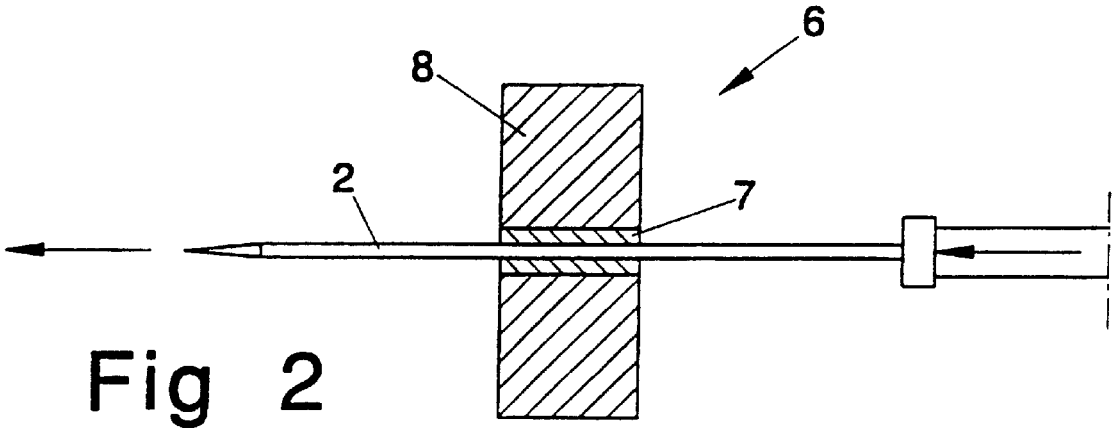
FIG. 2 shows a section through a device with inductive heating according to the present invention.

According to one embodiment of the invention shown in FIG. 2, the heating device 6 is in the form of an inductive heater, placed on the heating section 7 of a certain stretch along the hot-air unit 2. Upon inductive heating the heating section 7 is enclosed by an inductive heater 8 in the form of a coil supplied with high-frequency alternating current. The frequency of the current is chosen depending on the heating desired. If the frequency is increased, heating will be concentrated to the layer closest to the outer surface of the heating section 7, whereas a lower frequency will produce heating further into the material. The heating is obtained by a rapidly alternating magnetic field which passes through the heating portion 7 and produces eddy currents in the material. The current losses heat the hot-air unit 2 and the air therein. An embodiment in which the heating section 7 is removed is also feasible within the scope of the invention. The high-frequency alternating current is produced in generators operating in the frequency range 4–30 Mp/s for power factors up to 100 kW.

Figure 3:
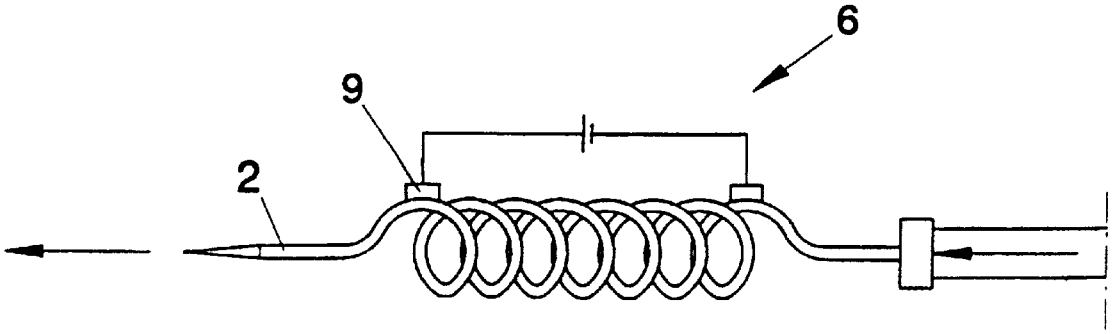
FIG. 3 shows a section through a device with electric heating according to the present invention.

FIG. 3 shows another embodiment in which the hot-air unit 2 is in the form of a coil, in which case the heating device 6 consists of a resistive electric heater 9.

In all the embodiments described above, the hot-air unit 2 is shaped as a cylindrical tube of acid-proof steel having uniform diameter along its axial extension. Its cutting nozzle has an out-flow opening with a diameter of approximately 0.01–2.00 mm, i.e. equivalent to a gas welding nozzle.

The hot-air unit can be shaped in several advantageous ways within the scope of the following claims, e.g. with varying diameter in order to achieve a different degree of compression on the nozzle side.

What is claimed is:

1. A method for hot air cutting through porous material comprising the steps of:

forcing compressed air into a hot air heating unit for heating the compressed air;

conducting the hot air out of the hot heating unit through a cutting nozzle having an outflow opening with a diameter of 0.01–2.0 mm; and directing the air nozzle onto and through the porous material to be cut by the hot air.

2. The method of claim 1, wherein the compressed air is heated in a cylindrical shape hot air unit, and the compressed air is forced into the cylindrical shape hot air unit and the compressed air is then conducted out of the hot air unit through the nozzle.

3. The method of claim 1, wherein the heating of the air comprises heating the hot air unit by directly heating an area of the hot air unit using a burner.

4. The method of claim 1, wherein the heating of the air comprises heating the hot air unit by heating an area of the hot air unit with an inductive heater.

5. The method of claim 1, wherein the air is heated by electric heating.

* * * * *